US009976343B1

(12) United States Patent
Worth

(10) Patent No.: US 9,976,343 B1
(45) Date of Patent: May 22, 2018

(54) STORM SHUTTER BRACKET AND ATTACHMENT SYSTEM

(71) Applicant: Joel A. Worth, Tarpon Springs, FL (US)

(72) Inventor: Joel A. Worth, Tarpon Springs, FL (US)

(73) Assignee: Wortec LLC, Tarpon Springs, FL (US)

( * ) Notice: Subject to any disclaimer, the term of this patent is extended or adjusted under 35 U.S.C. 154(b) by 0 days. days.

(21) Appl. No.: 15/803,356

(22) Filed: Nov. 3, 2017

(51) Int. Cl.
*E06B 9/02* (2006.01)
*E06B 9/00* (2006.01)

(52) U.S. Cl.
CPC ..... *E06B 9/02* (2013.01); *E06B 2009/005* (2013.01)

(58) Field of Classification Search
CPC ..... F16B 41/002; F16B 19/02; F16B 35/04; F16B 45/00; Y10T 403/1616; Y10T 403/299; Y10T 403/33; Y10T 403/335; E05D 5/121; E06B 1/6076; E06B 9/02
See application file for complete search history.

(56) References Cited

U.S. PATENT DOCUMENTS 4,196,883 A * 4/1980 Einhorn ..... F16B 13/003 248/231.21
4,732,519 A * 3/1988 Wagner ..... F16B 5/0258 403/14
5,285,543 A 2/1994 Rowe
5,634,618 A 6/1997 Farmer, Jr. et al.
5,941,031 A * 8/1999 Fullwood ..... E06B 3/00 52/202
6,014,841 A * 1/2000 McCoy, Jr. ..... E04B 9/003 182/46
6,263,625 B1 7/2001 LaPointe
6,272,952 B1 8/2001 Hsu et al.
6,295,773 B1 * 10/2001 Alty ..... E04F 13/0837 411/178
6,363,670 B1 4/2002 Dewitt
6,397,709 B1 6/2002 Wall
6,532,702 B1 * 3/2003 Scribner ..... E06B 9/02 411/348
6,662,511 B1 * 12/2003 Alty ..... E04F 13/0837 411/178
6,978,579 B1 12/2005 Trinca
7,654,044 B2 2/2010 Borland
7,861,472 B2 1/2011 Thompson
8,196,363 B2 6/2012 Hay et al.
8,297,011 B2 10/2012 Quick et al.
8,490,670 B2 * 7/2013 Miller ..... E06B 9/17 160/133

(Continued)

*Primary Examiner* — Gisele D Ford
(74) *Attorney, Agent, or Firm* — Paul Murty; Smith & Hopen, P.A.

(57) ABSTRACT

A storm shutter attachment system that provides for the temporary installation of a storm shutter against a window or a door during a period of extreme weather conditions, such as a hurricane or a tornado. The storm shutter utilizes an anchor pin and a retention pin to securely install within a building and exert a force against a storm shutter. A plurality of anchor pins and retention pins may be used to displace the pressure across the storm shutter, further protecting the window or door. A multipurpose tool is also provided that is couplable to the retention pin of the attachment system, allowing for a simple installation of the attachment system without requiring a professional.

20 Claims, 6 Drawing Sheets

(56) References Cited

U.S. PATENT DOCUMENTS

| | | | | |
|---|---|---|---|---|
| 8,821,094 | B2 * | 9/2014 | McDuff | F16B 13/0808 411/340 |
| 9,228,391 | B2 | 1/2016 | Nugent | |
| 2001/0015038 | A1 | 8/2001 | Cadalso | |
| 2007/0101667 | A1 | 5/2007 | Sweet, Jr. et al. | |
| 2007/0204530 | A1 * | 9/2007 | Janesky | E02D 19/00 52/169.14 |
| 2008/0110099 | A1 | 5/2008 | Famulare et al. | |
| 2015/0191885 | A1 * | 7/2015 | Wu | E02B 7/28 405/90 |
| 2016/0145861 | A1 * | 5/2016 | Wexler | E06B 9/02 52/202 |

* cited by examiner

STORM SHUTTER BRACKET AND ATTACHMENT SYSTEM

BACKGROUND OF THE INVENTION

1. Field of the Invention

This invention relates, generally, to storm shutters. More specifically, it relates to a storm shutter bracket and attachment system, including an anchor pin and an adjustable retention pin, configured to retain a storm shutter over windows and doors during extreme weather conditions.

2. Brief Description of the Prior Art

In areas that experience extreme weather conditions, such as hurricanes or tornados, it is often necessary to cover windows, doors, and other building surfaces and openings with storm shutters. Permanent storm shutters may be installed on a building's exterior surface and may be deployed to prevent damage to a window or door, as well as prevent high winds, moisture, debris, insects, and animals from entering the building. However, permanent storm shutters are not removable from the building, which can negatively affect the aesthetic qualities of the building. Moreover, permanent storm shutters often require a professional installation, with amateurs being unable to install the shutters without proper training.

Due to the shortcomings of permanent storm shutters, temporary storm shutters may be used to cover a window or door during a period of extreme weather conditions, only to be removed when the weather conditions normalize. A common temporary storm shutter is a sheet of plywood that is installed adjacent to a window or door, often by nailing or screwing the plywood into the exterior surface of the building. However, such an installation typically requires screws to be drilled through the plywood and perpendicular to the building, creating porous holes in the plywood while failing to install the plywood substantially adjacent to the window. As such, there are gaps between the window and the plywood, through which water, debris, and wind can potentially enter the building.

Alternatively, U.S. Pat. No. 5,634,618 teaches clips used to retain a sheet of plywood substantially adjacent to the window or door, allowing for the installation of storm shutters with minimal building modification. The clips are designed to hold the plywood against the window by applying tension between the plywood and the exterior surface of the building. However, the clips often dislodge during extreme weather conditions, because they are not anchored against the building through a screw or other attachment. Further, the clips that remain after the storm are often difficult to remove and can cause damage to the exterior surface of the building.

Accordingly, what is needed is a storm shutter attachment system that can be easily and safely installed and removed without requiring any specialized skills. However, in view of the art considered as a whole at the time the present invention was made, it was not obvious to those of ordinary skill in the field of this invention how the shortcomings of the prior art could be overcome.

BRIEF SUMMARY OF THE INVENTION

The long-standing but heretofore unfulfilled need for a temporary storm shutter attachment system that can be installed on the exterior or interior of a building, which protects windows and doors is now met by a new, useful, and nonobvious invention.

The novel structure includes a storm shutter attachment system including an anchor pin and an adjustable retention pin. The anchor pin includes an elongated shaft adapted to reside within a pre-drilled hole within a building wall or window jamb. The elongated shaft may be configured to rotate within the pre-drilled hole. The anchor portion also includes a head portion configured to protrude from the pre-drilled hole. A through-hole is disposed within the head portion, with the through-hole having an inner surface and a first center axis. A first ridge, which may be a first thread, is disposed on the inner surface of the through-hole.

The retention pin is configured to immobilize a storm shutter, which may be made from a variety of materials, including plywood, corrugated steel, aluminum, rubber, polyurethane, vinyl, fabric, and hybrid materials. The retention pin is adjustably disposed within the through-hole of the anchor pin, and is capable of linear movement within the through-hole along the first center axis. To couple with the anchor pin, the retention pin includes an outer surface that is configured to mate with the inner surface of the through-hole. The retention pin includes a second ridge on the outer surface of the retention pin, with the second ridge engaging the first ridge of the through-hole. When the first ridge and the second ridge engage, the retention pin is immobilized against axial movement along the first center axis of the through-hole in at least a first axial direction. The second ridge may be a complementary thread to the first thread of the through-hole.

The retention pin includes a second center axis that is adjustable based on the rotation of the anchor pin within the pre-drilled hole. In order to install against a storm shutter, the second center axis aligns with the first center axis of the through-hole, orienting the second center axis substantially perpendicular to a surface of the storm shutter. When the retention pin is rotated about the second center axis, the retention pin may move axially along the first center axis to a position in which the retention pin engages a storm shutter and applies a force onto the surface thereof, the force having sufficient magnitude to immobilize the storm shutter. The retention pin may include a substantially planar attachment head that couples to and exerts a force against the storm shutter. The attachment head may include a male component extending in a direction away from the retention pin and toward the storm shutter when the retention pin couples to the anchor pin. The male component is insertable into the storm shutter.

The retention pin may include a tool driver coupling portion that includes a driver attachment, which may be a slot, cross, Phillips, square, hex, star, knob, or combination driver. A multipurpose tool may be couplable to the tool driver coupling portion to translate the retention pin along the first center axis of the through-hole. The multipurpose tool may include a threading and a driver, allowing different sides of the multipurpose tool to couple with the retention pin.

In an embodiment, the storm shutter attachment system includes a nut having a thread disposed on an inner surface thereof. The nut thread is complementary to the threading on the outer surface of the retention pin. In this embodiment, a storm shutter includes a hole having a diameter larger than a diameter of the retention pin. The storm shutter is positioned over the retention pin, allowing the retention pin to pass through the hole. The storm shutter is immobilized with respect to the retention pin by screwing the nut onto an end of the retention pin protruding through the hole of the storm shutter.

An object of the invention is to provide a removable storm shutter attachment bracket that allows a user to easily and efficiently install and remove storm shutters that are secured against a building without the need to drill through the storm shutters. Instead, pressure is applied against a storm shutter through a bracket anchored in the building, securing the shutter against a window or door during periods of extreme weather conditions.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

As used in this specification and the appended claims, the singular forms "a," "an," and "the" include plural referents unless the content clearly dictates otherwise. As used in this specification and the appended claims, the term "or" is generally employed in its sense including "and/or" unless the context clearly dictates otherwise.

The present invention includes a storm shutter bracket used to secure a storm shutter against a window, door, or other building opening, particularly during periods of extreme weather conditions, such as a hurricane or a tornado. Rather than installing a permanent storm shutter system, the storm shutter bracket of the present invention is detachably coupled to the building, such that it can be removed during periods of non-use. Moreover, rather than using clips that are difficult to install and remove, and that often dislodge during a storm, the storm shutter bracket is anchored into the building, providing sufficient stability to apply pressure against a storm shutter. The storm shutter bracket may be used on storm shutters made from a variety of materials, such as plywood, corrugated steel, aluminum, rubber, polyurethane, vinyl, fabric, hybrids, and other materials that may form a barrier between a window and extreme weather conditions.

Figure 1:
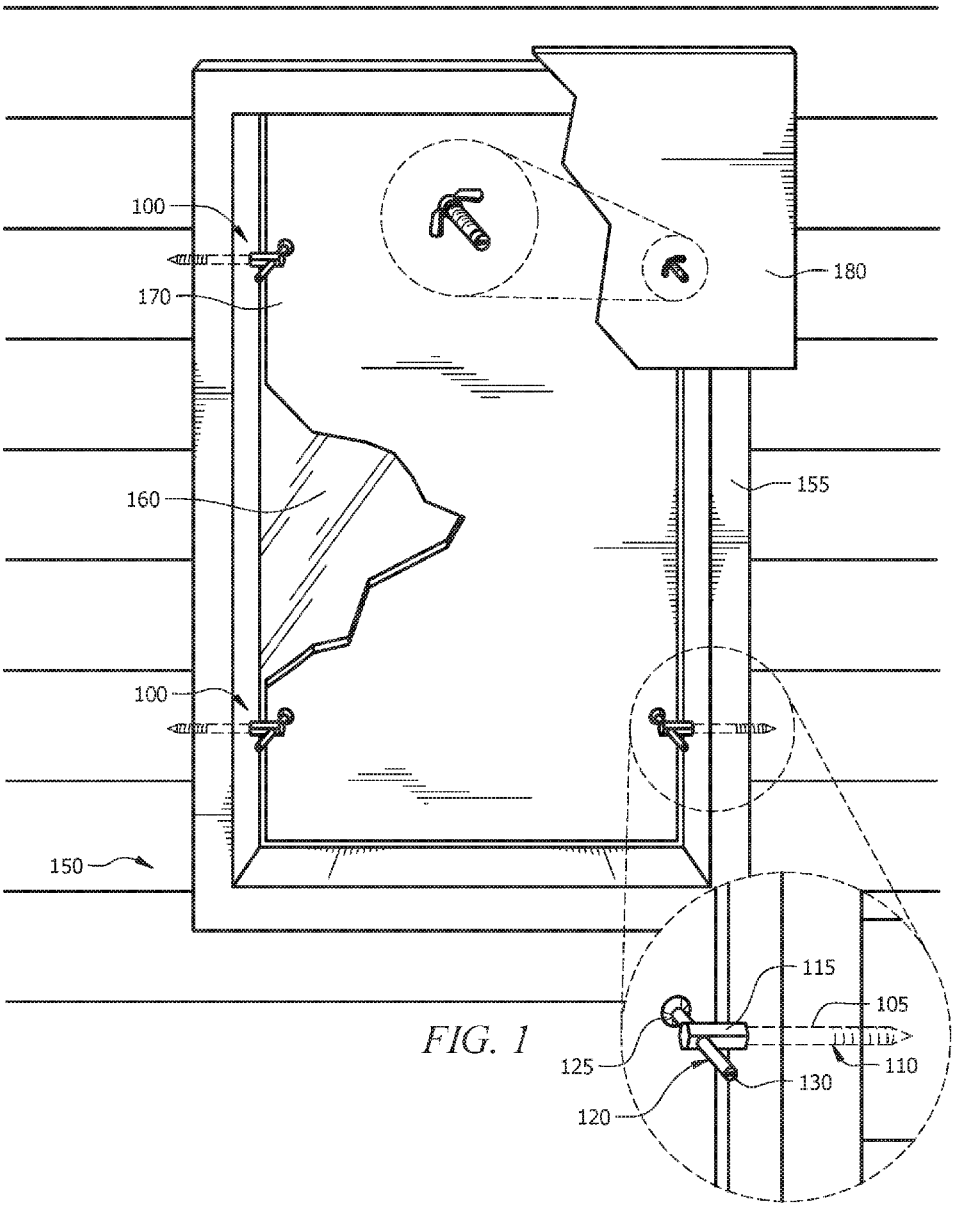
FIG. 1 is a perspective front view of a storm shutter attachment system, including a plurality of storm shutter brackets employed on an exterior of a building, to secure at least one of an inner storm shutter and an outer storm shutter adjacent to a window.

As shown in FIG. 1, storm shutter bracket 100 includes anchor pin 110, which includes elongated shaft 105. Anchor pin 110 is installed into a pre-drilled hole within building wall 150 or window jamb 155 by inserting elongated shaft 105 within building wall 150, either on the exterior or the interior of a building. For example, in one embodiment, anchor pin 110 is installed into window jamb 155 on the exterior of building wall 150. However, anchor pin 110 may be installed elsewhere on the exterior of building wall 150. Alternatively, anchor pin 110 may be installed on the interior of building wall 150 into concrete, brick, wood, drywall, or other material, particularly when an exterior surface is unreachable, such as in a high-rise apartment building.

In order to facilitate the installation of elongated shaft 105 within building wall 150, anchor pin 110 includes head portion 115 coupled to elongated shaft 105. Head portion 115 couples to elongated shaft 105 via welding, threading, or other retention means. Head portion 115 may be hexagonal in shape to allow for the attachment of a wrench or other tool. Alternatively, head portion 115 may include a tool attachment point that may be a slot, cross, Phillips, square, hex, star, knob, or other shape that allows for the attachment of a tool to install anchor pin 110 in building wall 150. By providing for a fitting for a tool, head portion 115 allows for elongated shaft 105 to be anchored in building wall 150 with a tight fit, substantially preventing moisture, dirt, and insects from entering building wall 150. To further facilitate installation, an embodiment of elongated shaft 105 is threaded to allow for a tight connection with building wall 150. In an alternative embodiment, elongated shaft 105 is smooth, allowing elongated shaft 105 to be securely retained within building wall 150 without screwing into building wall 150. Moreover, if elongated shaft 105 is smooth, a user can easily rotate elongated shaft 105 to remove storm shutter bracket 100 from building wall 150. As such, if elongated shaft 105 is smooth, anchor pin 110 rotationally resides within a pre-drilled hole within building wall 150 or window jamb 155. An embodiment of elongated shaft 105 is installed into a sleeve disposed within building wall 150, such as a metal or plastic wall anchor. The sleeve may be permanently installed within a drilled hole in building wall 150 to further prevent moisture and debris from entering building wall 150. A plug may be used to further protect the drilled holes in building wall 150 when the elongated shaft 105 is not in use.

Storm shutter bracket 100 is formed when retention pin 120 mates with anchor pin 110 at head portion 115, forming a substantially 90° angle (±10°). Since anchor pin 110 rotationally resides within building wall 150 or window jamb 155, the orientation of anchor pin 110 dictates the orientation of retention pin 120. Retention pin 120 is adapted to exert a force in the direction of its center axis on inner storm shutter 170 when storm shutter bracket 100 is formed. Thus, by rotating anchor pin 110, the user can adjust the direction of the force vector being applied by retention pin 120 onto inner storm shutter 170.

An embodiment of retention pin 120 includes attachment head 125 and tool driver coupling portion 130. Attachment head 125 is adapted to exert a force against inner storm shutter 170, thereby immobilizing inner storm shutter 170. In an embodiment, attachment head 125 is planar and is disposed adjacent to inner storm shutter 170 while in use, without being inserted within inner storm shutter 170. Tool driver coupling portion 130 is adapted to translate retention pin 120 with respect to anchor pin 110 by allowing for a tool to mate with retention pin 120.

In one embodiment, storm shutter bracket 100 may be used to secure outer storm shutter 180 against an exterior surface of building wall 150. In this embodiment, outer storm shutter 180 includes a hole having a diameter larger than a diameter of retention pin 120. Outer storm shutter 180 is immobilized with respect to retention pin 120 when retention pin 120 passes through the hole. The tight seal that is created a prevents moisture, debris, and insects from penetrating through outer storm shutter 180.

As shown in FIG. 1, a plurality of storm shutter brackets 100 may be used to secure inner storm shutter 170 against window 160. To remove the force applied normal to window 160, an embodiment utilizes at least four storm shutter brackets 100. Other multiples of storm shutter brackets 100 may be used, so long as inner storm shutter 170 is secured against window 160. In an alternative embodiment, storm shutter brackets 100 secure outer storm shutter 180 against an exterior surface of building wall 150. Storm shutter brackets 100 may also be used to secure both inner storm shutter 170 and outer storm shutter 180 against building wall 150.

Figure 2A:
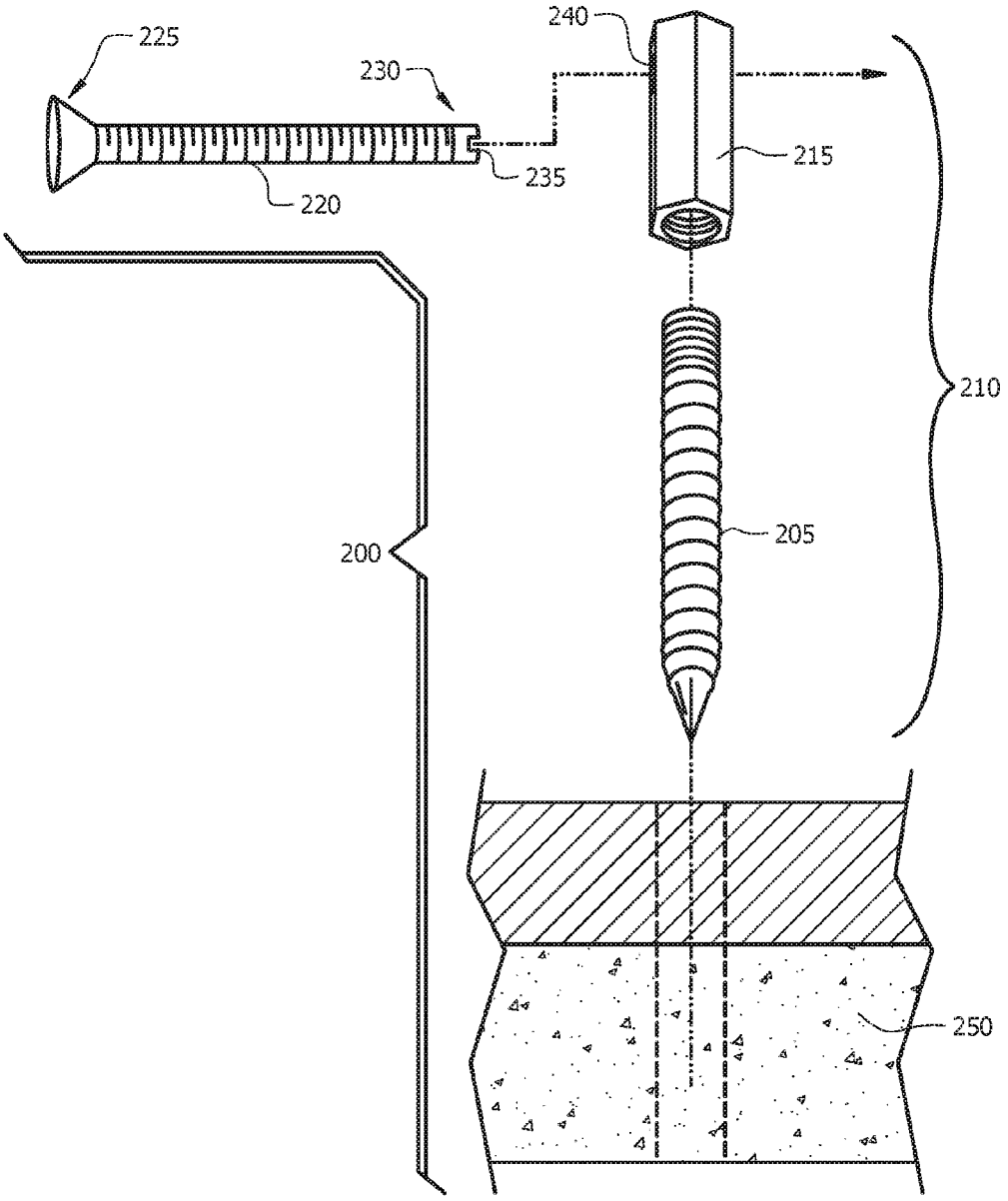
FIG. 2A is a perspective view of a storm shutter bracket, showing the coupling relationship between the anchor pin and the retention pin.

FIG. 2A depicts an embodiment of storm shutter bracket 200 in detail, including anchor pin 210 and retention pin 220. Elongated shaft 205, which may be installed within building wall 250, is shown as coupled to head portion 215 via threading. Elongated shaft 205 and head portion 215 may alternatively be welded together, or may form a solid and continuous body. Anchor pin 210 includes through-hole 240, which is disposed within head portion 215. Through-hole 240 is shown in greater detail in FIG. 2C. In alternative embodiments, through-hole 240 may be disposed within elongated shaft 205, or multiple through-holes 240 may be disposed within anchor pin 210. Through-hole 240 includes an inner surface and a center axis. A first ridge is disposed on the inner surface of through-hole 240. The first ridge may be a first thread.

Figure 2B:
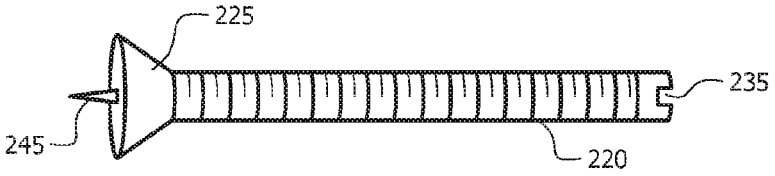
FIG. 2B is a perspective side view of an embodiment of the retention pin.
Figure 2C:
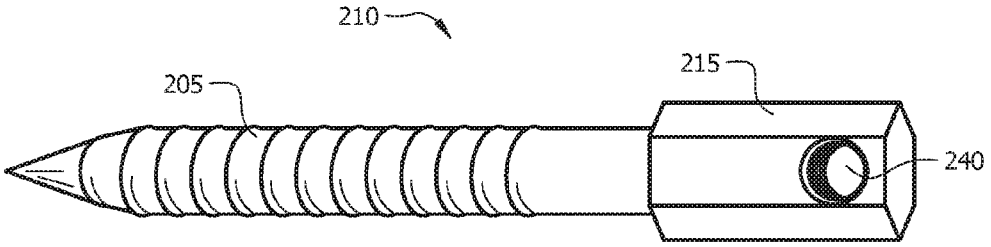
FIG. 2C is a perspective side view of an embodiment of the anchor pin.

Retention pin 220 mates with anchor pin 210 by inserting retention pin 220 through through-hole 240, as shown in FIG. 2A. The outer surface of retention pin 220 includes a second ridge. The second ridge engages the first ridge of through-hole 240. If the first ridge is a first thread, the second ridge is a second thread that is complementary. When the second ridge engages the first ridge, retention pin 220 is immobilized against axial movement along the center axis of through-hole 240 in at least a first axial direction. Retention pin 220 is configured to be rotated about its center axis. When the center axis of retention pin 220 aligns with the center axis of through-hole 240, retention pin 220 moves axially along the axes. As such, retention pin 220 may be rotated and translated to engage a storm shutter, applying a force onto the surface of the storm shutter that has sufficient magnitude to immobilize the storm shutter. Attachment head 225 of retention pin 220 may include male component 245, as shown in FIG. 2B, to be inserted within the storm shutter, further immobilizing the storm shutter. The orientation of through-hole 240 dictates the orientation of retention pin 220, because anchor pin 210 rotationally resides within a pre-drilled hole in a building wall or window jamb. By rotating anchor pin 210, a user can change the orientation of through-hole 240, thereby adjusting the direction of the force vector being applied by retention pin 220 a storm shutter.

To facilitate the translation of retention pin 220 with respect to anchor pin 210, retention pin 220 includes driver attachment 235 on tool driver coupling portion 230. By connecting a corresponding tool to driver attachment 235, attachment head 225 may be translated toward and away from inner storm shutter 170, as depicted in FIG. 1. Driver attachment 235 is shown as a slot which can receive a flat screwdriver bit. Driver attachment 235 may alternatively be a cross, Phillips, hex, star, knob, combination, or other drive attachment that allows for a tool to translate retention pin 220.

Figure 3A:
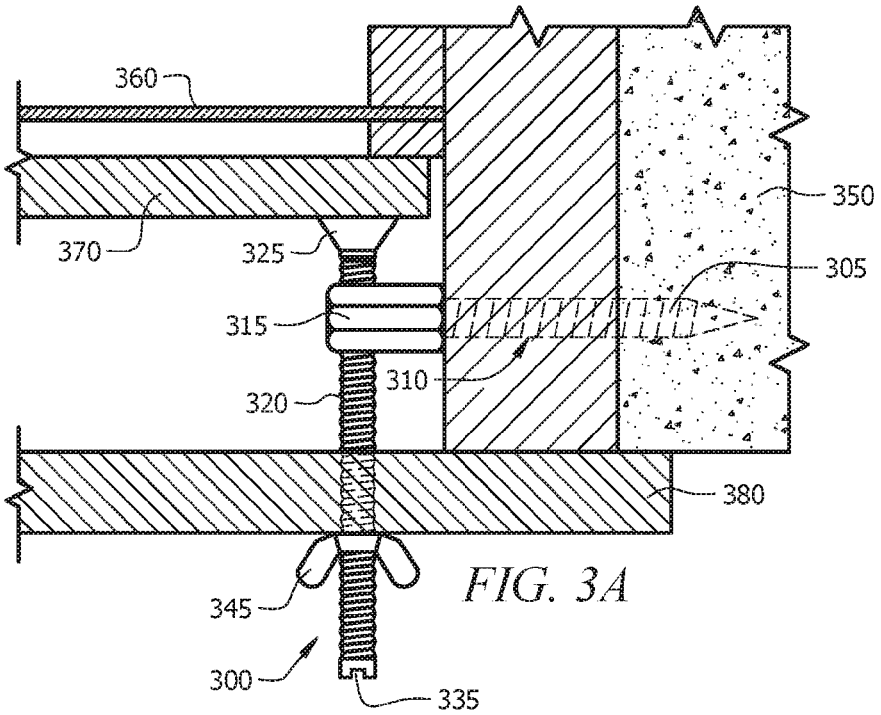
FIG. 3A is a top view of a storm shutter bracket used to retain an inner storm shutter and an outer storm shutter against a window and a building, respectively.

FIG. 3A depicts an embodiment of a storm shutter attachment system utilizing storm shutter bracket 300 to install inner storm shutter 370 and outer storm shutter 380. Storm shutter bracket 300 includes anchor pin 310, with elongated shaft 305 of anchor pin 310 rotationally residing within building wall 350. Anchor pin 310 includes head portion 315 disposed to receive retention pin 320 through a though-hole. Retention pin 320 is shown having a first thread disposed between attachment head 325 and driver attachment 335.

Figure 3B:
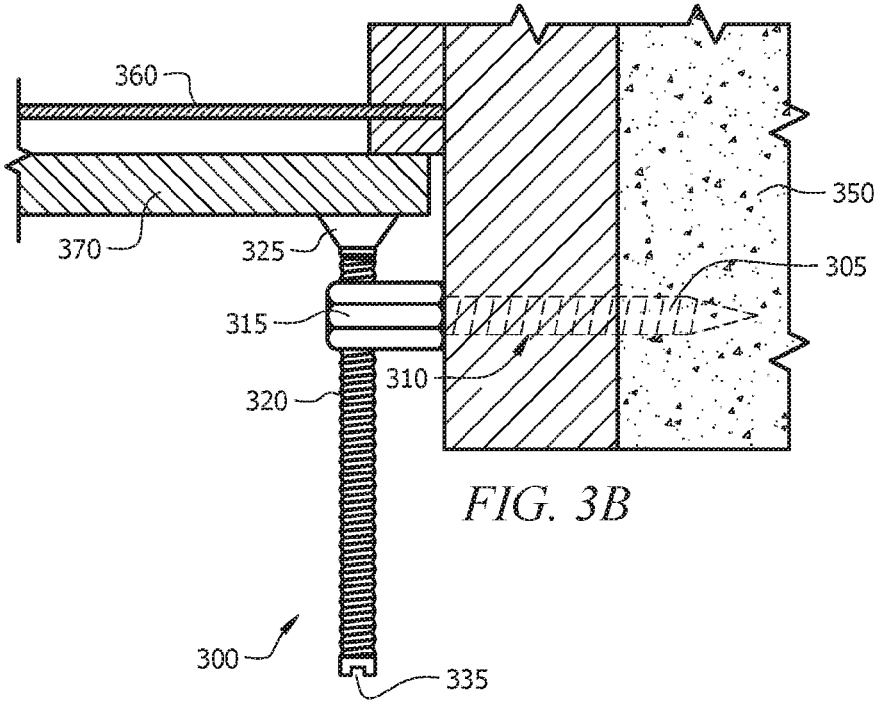
FIG. 3B is a top view of a storm shutter bracket used to retain an inner storm shutter against a window.
Figure 3C:
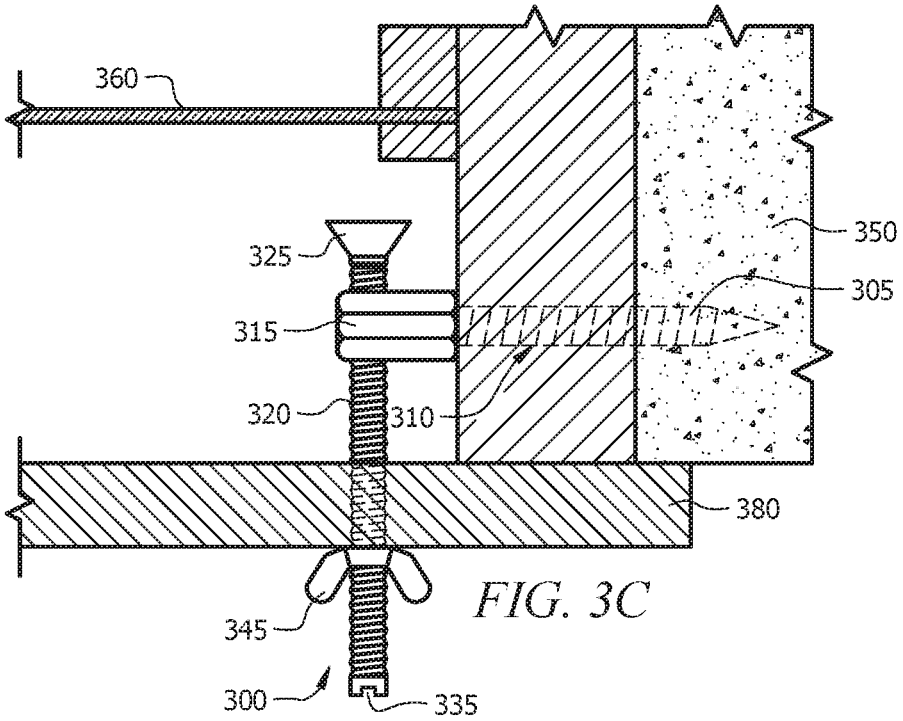
FIG. 3C is a top view of a storm shutter bracket used to retain an outer storm shutter against a building.

To facilitate the installation of outer storm shutter 380, an embodiment of storm shutter bracket 300 includes nut 345 disposed on retention pin 320. Nut 345 includes a second thread disposed on an inner surface thereof, which is configured to screw-threadedly mate with a first thread on retention pin 320. In FIG. 3A, nut 345 is depicted as a wingnut; however, it is appreciated that other types of nuts may be used, alone or in combination with washers, to secure against outer storm shutter 380. While FIG. 3A depicts the use of a singular nut 345 disposed against an exterior surface of outer storm shutter 380, multiple nuts 345 may be used to secure outer storm shutter 380 against an exterior surface of building 350. Alternatively, nut 345 may be disposed against an interior surface of outer storm shutter 380. FIG. 3B shows the installation of just inner storm shutter 370. Similarly, FIG. 3C shows the installation of just outer storm shutter 380.

Figure 4:
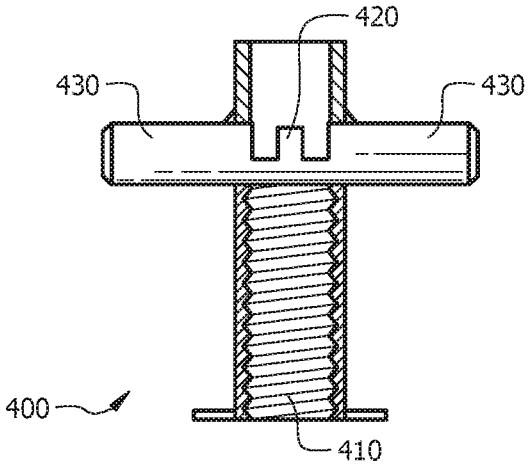
FIG. 4 is a section view of a multipurpose tool operably configured for use with a storm shutter bracket.

An embodiment of a storm shutter attachment system includes multipurpose tool 400, as depicted in FIG. 4. Multipurpose tool 400 is adapted to perform at least two functions. For example, as shown in FIG. 4, multipurpose tool 400 includes threading 410. As such, multipurpose tool 400 may function as a nut, coupling to a threaded bolt to translate the bolt. FIG. 4 also depicts multipurpose tool 400 including driver 420, which is shown as a flathead driver bit. In an embodiment, handles 430 are disposed between threading 410 and driver 420. Handles 430 provide torque to utilize multipurpose tool 400 to manipulate a storm shutter bracket in a shutter attachment system.

Multipurpose tool 400 is operably configured to couple to a storm shutter bracket, such as storm shutter bracket 300 (as shown in FIG. 3). As such, multipurpose tool 400 is adapted to couple to driver attachment 335 of retention pin 320 to translate retention pin 320 with respect to anchor pin 310. Because driver attachment 335 is depicted as being a slot, multipurpose tool 400 includes flathead driver 420. Similarly, because retention pin 320 is depicted as being threaded, multipurpose tool 400 includes threading 410.

Multipurpose tool 400 can be used as a nut by engaging threading 410 with retention pin 320. As such, multipurpose tool 400 can replace nut 345 to secure retention pin 320 against outer storm shutter 380. Conversely, the side of multipurpose tool 400 including flathead driver 420 is substantially smooth and is not threaded. Accordingly, flathead driver 420 can couple with driver attachment 335 without engaging with the threading on retention pin 320. Depending on the shape of driver attachment 335 and the configuration of retention pin 310, embodiments of multipurpose tool 400 include a variety of drivers and configurations, such as a cross, Phillips, square, hex, star, knob, or a combination driver bit.

Figure 5:
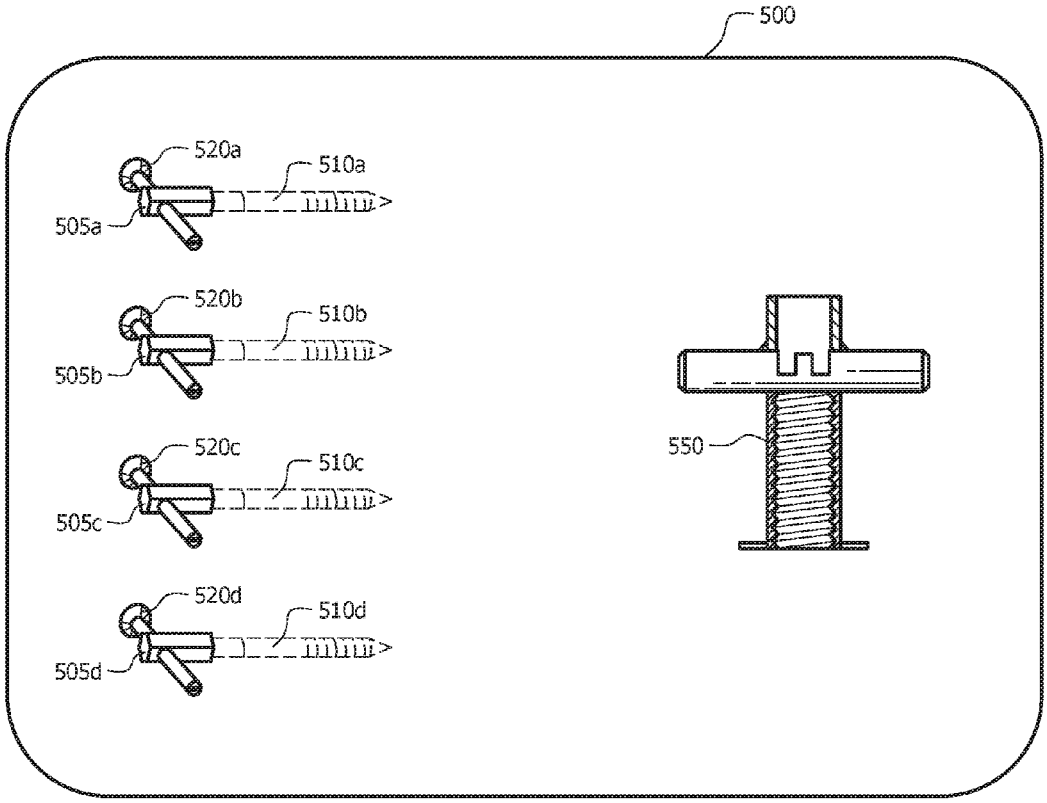
FIG. 5 is a perspective view of a kit including a plurality of storm shutter brackets and a multipurpose tool, in accordance with an embodiment of the present invention.

FIG. 5 depicts storm shutter attachment kit 500, which includes at least one storm shutter bracket 505*a*, having anchor pin 510*a* and retention pin 520*a*. Kit 500 also includes multipurpose tool 550 adapted to retention pin 520*a* with respect to anchor pin 510*a*. As shown in FIG. 5, an embodiment of storm shutter attachment kit 500 includes a plurality of storm shutter brackets 505*a*, 505*b*, 505*c*, 505*d*, each of which includes an anchor pin and a retention pin. Accordingly, storm shutter bracket kit 500 provides all of the component parts necessary to secure a storm shutter against a window or a door of a building, without the need to separately locate the component parts. Further, since multipurpose tool 550 is operably configured to couple to the retention pins of storm shutter brackets 505*a*, 505*b*, 505*c*, 505*d*, a separate tool is not needed to install storm shutters, thereby preparing a building for a period of extreme weather conditions.

Glossary of Claim Terms

Retention pin: is a pin that may be translated with respect to an anchor pin.

Anchor pin: is a pin that may be installed in a surface, such as a building, door frame, or window jamb.

Through-hole: is an opening or through-bore.

Multipurpose tool: is a tool that is capable of at least two functions via different attachment ends.

Opposite: being on other ends of a structure.

Pin: is a bolt, screw, or other structure having a shaft.

Storm shutter: is a piece of material that may be installed over a window, door, or other opening on a building, particularly during periods of extreme weather conditions.

Storm shutter bracket: is a structure that is adapted to retain a storm shutter adjacent to a building.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, Applicant in no way disclaims these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A storm shutter attachment system comprising:

a first pin adapted to function as an anchor pin, the first pin having an elongated shaft and a head portion, the elongated shaft configured to reside within a pre-drilled hole within a building wall or a window jamb and the head portion configured to protrude from the pre-drilled hole, wherein a center longitudinal axis of the pre-drilled hole is parallel with respect to a surface of a window;

an aperture disposed within the head portion of the first pin, the aperture having an inner surface and a center axis, wherein the center axis is perpendicular to the elongated shaft of the first pin;

a second in coupled to the first pin, the second pin disposed within the aperture of the first pin, such that the second pin axially translates within the aperture along the center axis thereof, the second pin adapted to function as a retention pin, whereby the second pin is configured to exert a force onto a storm shutter in a direction perpendicular to the storm shutter;

a first ridge disposed on the inner surface of the aperture of the first pin; and a second ridge disposed on the outer surface of the second pin, the second ridge engaging the first ridge, thereby immobilizing the second pin against axial movement along the center axis of the aperture, thus securing the storm shutter over the window.

2. The storm shutter attachment system of claim 1, wherein:

the first and second ridges are complementary threads.

3. The storm shutter attachment system of claim 1, wherein:

the elongated shaft of the first pin is configured to rotationally reside within the pre-drilled hole within the building wall or the window jamb.

4. The storm shutter attachment system of claim 3, wherein:

an orientation of the second pin is adjustable by rotating the first pin within the pre-drilled hole such that a center axis of the second pin is oriented substantially perpendicular to a surface of the storm shutter.

5. The storm shutter attachment system of claim 1, wherein the second pin further comprises:

a substantially planar attachment head configured to exert the force onto the storm shutter in the direction perpendicular to the storm shutter.

6. The storm shutter attachment system of claim 5, wherein:

the attachment head includes a male component extending in a direction away from the second pin and toward the storm shutter when the second pin couples to the first pin, with the male component insertable into the storm shutter.

7. The storm shutter attachment system of claim 5, wherein the second pin further comprises:

a tool driver coupling portion opposite the attachment head, the tool driver coupling portion adapted to translate the second pin with respect to the first pin.

8. The storm shutter attachment system of claim 7, wherein:

the tool driver coupling portion includes a driver attachment that is selected from the group consisting of a slot, cross, Phillips, square, hex, star, or a combination driver.

9. The storm shutter attachment system of claim 7, further comprising:

a multipurpose tool including a threading and a driver, each of the threading and the driver couplable with the tool driver coupling portion to linearly translate the second pin along the center axis of the aperture.

10. The storm shutter attachment system of claim 1, wherein:

the magnitude of the force exerted on the storm shutter by the second pin is controlled by axially translating the second pin within the aperture of the first pin.

11. A storm shutter attachment system comprising:

an anchor pin having an elongated shaft and a head portion, the elongated shaft configured to rotationally reside within a pre-drilled hole within a building wall or a window jamb and the head portion configured to protrude from the pre-drilled hole, wherein the pre-drilled hole is parallel with respect to a surface of a window;

an aperture disposed within the head portion of the anchor pin, the aperture having an inner surface and a first center axis, wherein the first center axis is perpendicular to the elongated shaft of the anchor pin, a first thread disposed on the inner surface of the aperture;

a retention pin coupled to the anchor pin, the retention pin adjustably disposed within the aperture of the anchor pin such that the retention pin axially translates within the aperture along the first center axis thereof, the retention pin having a second center axis, parallel to the first center axis; and a second thread disposed on an outer surface of the retention pin, the second thread configured to mate with the first thread, whereby rotation of the retention pin about the second center axis causes the retention pin to move axially along a direction of the first center axis;

wherein an orientation of the retention pin is adjustable by rotating the anchor pin within the pre-drilled hole such that the second center axis is oriented substantially perpendicular to a surface of a storm shutter, and wherein the retention pin is configured to be rotated about the second center axis such that the retention pin moves axially along the first axis to a position in which the retention pin perpendicularly engages the storm shutter and applies a force onto the surface thereof having sufficient magnitude to secure the storm shutter over the window.

12. The storm shutter attachment system of claim 11, wherein the retention pin further comprises:

a substantially planar attachment head configured to exert a force normal to the storm shutter.

13. The storm shutter attachment system of claim 12, wherein:

the attachment head includes a male component extending in a direction away from the retention pin and toward the storm shutter when the retention pin couples to the anchor pin, with the male component insertable into the storm shutter.

14. The storm shutter attachment system of claim 11, wherein the retention pin further comprises:

a tool driver coupling portion adapted to translate the retention pin with respect to the anchor pin, the tool driver coupling portion including a driver attachment that is selected from the group consisting of a slot, cross, Phillips, square, hex, star, or a combination driver.

15. The storm shutter attachment system of claim 14, further comprising:

a multipurpose tool including a threading and a driver, each of the threading and the driver couplable with the tool driver coupling portion to linearly translate the retention pin along the first and second center axes.

16. The storm shutter attachment system of claim 11, wherein:

the storm shutter is made of a material that is selected from the group consisting of plywood, corrugated steel, aluminum, rubber, polyurethane, vinyl, fabric, and a hybrid material.

17. A storm shutter attachment system comprising:

a first pin adapted to function as an anchor pin, the first pin having an elongated shaft and a head portion, the elongated shaft configured to reside within a pre-drilled hole within a building wall or a window jamb and the head portion configured to protrude from the pre-drilled hole, wherein a center longitudinal axis of the pre-drilled hole is parallel with respect to a surface of a window;

a second pin adapted to function as a retention pin, the second pin coupled to the first pin, the second pin having a center axis, wherein the center axis is perpendicular to the elongated shaft of the first pin;

a first thread disposed on an outer surface of the second pin;

a nut having a second thread disposed on an inner surface thereof configured to screw-threadedly mate with the first thread of the second pin;

a storm shutter having a hole with a diameter larger than a diameter of the second pin;

whereby the storm shutter is positioned over the second pin such that the second pin passes through the hole, the storm shutter being immobilized with respect to the second pin by screwing the nut onto an end of the retention pin protruding through the hole of the storm shutter.

18. The storm shutter attachment system of claim 17, wherein the first pin further comprises:

an aperture disposed within the head of the first pin, the aperture having a third thread disposed on an inner surface thereof and a second center axis, wherein the second center axis is perpendicular to the elongated shaft of the first pin;

wherein the second pin is adjustably disposed within the aperture, with the outer surface of the second pin mating with the inner surface of the through-hole, allowing the second pin to axially translate within the aperture along the second center axis.

19. The storm shutter attachment system of claim 17, wherein:

an orientation of the second pin is adjustable by rotating the first pin within the pre-drilled hole such that the center axis of the second pin is oriented substantially perpendicular to a surface of the storm shutter.

20. The storm shutter attachment system of claim 17, further comprising:

a multipurpose tool couplable with the second pin to linearly translate the second pin along the center axis.

* * * * *